US008783379B2

(12) United States Patent
Stave

(10) Patent No.: US 8,783,379 B2
(45) Date of Patent: Jul. 22, 2014

(54) FLUID TRANSFER DEVICE USABLE IN MANAGED PRESSURE AND DUAL-GRADIENT DRILLING

(76) Inventor: Roger Sverre Stave, Bergen (NO)

( * ) Notice: Subject to any disclaimer, the term of this patent is extended or adjusted under 35 U.S.C. 154(b) by 205 days.

(21) Appl. No.: 13/281,494

(22) Filed: Oct. 26, 2011

(65) Prior Publication Data

US 2013/0032396 A1 Feb. 7, 2013

Related U.S. Application Data

(60) Provisional application No. 61/514,517, filed on Aug. 3, 2011.

(51) Int. Cl.
*E21B 7/12* (2006.01)

(52) U.S. Cl.
CPC ..... *E21B 7/12* (2013.01)
USPC ..... 175/5; 175/207; 166/358

(58) Field of Classification Search
CPC ..... E21B 7/12; E21B 21/01
USPC ..... 175/5, 7, 207, 209, 212, 217; 166/344, 166/345, 352, 358, 367, 372, 75.12; 417/65, 118, 137, 138
See application file for complete search history.

(56) References Cited

U.S. PATENT DOCUMENTS

| | | | | |
|---|---|---|---|---|
| 4,755,111 | A * | 7/1988 | Cocchi et al. | 417/394 |
| 4,813,495 | A * | 3/1989 | Leach | 175/6 |
| 6,102,673 | A * | 8/2000 | Mott et al. | 417/392 |
| 6,230,824 | B1 * | 5/2001 | Peterman et al. | 175/214 |
| 6,325,159 | B1 * | 12/2001 | Peterman et al. | 175/7 |
| 6,454,022 | B1 * | 9/2002 | Sangesland et al. | 175/7 |
| 6,966,367 | B2 * | 11/2005 | Butler et al. | 166/105 |
| 7,066,247 | B2 * | 6/2006 | Butler et al. | 166/105 |
| 7,134,489 | B2 * | 11/2006 | Van Riet | 166/207 |
| 7,264,058 | B2 * | 9/2007 | Fossli | 166/367 |
| 7,819,195 | B2 * | 10/2010 | Ellis | 166/355 |
| 8,020,624 | B2 * | 9/2011 | Ocalan et al. | 166/372 |
| 8,277,201 | B2 * | 10/2012 | Krohn | 417/122 |

* cited by examiner

*Primary Examiner* — Matthew Buck
(74) *Attorney, Agent, or Firm* — Richard A. Fagin

(57) ABSTRACT

A fluid transfer device for use in wellbore drilling includes at least one pressure vessel having a fluid port at a bottom thereof for entry and discharge of a working fluid and a fluid port at a top thereof for entry and discharge of a power fluid. The pressure vessel has no physical barrier between the power fluid and the working fluid. Valves are coupled to the power fluid port for selective introduction of the power fluid into the at least one pressure vessel. Valves are coupled to the working fluid port such that the working fluid is constrained to flow in only one direction.

12 Claims, 4 Drawing Sheets

FLUID TRANSFER DEVICE USABLE IN MANAGED PRESSURE AND DUAL-GRADIENT DRILLING

CROSS-REFERENCE TO RELATED APPLICATIONS

Priority is claimed from U.S. Provisional Application No. 61/514,517 filed on 3 Aug. 2011 and incorporated herein by reference.

STATEMENT REGARDING FEDERALLY SPONSORED RESEARCH OR DEVELOPMENT

Not applicable.

BACKGROUND

The invention relates generally to the field of fluid transfer devices. More specifically, the invention relates to fluid transfer devices usable in so-called managed pressure drilling or dual-gradient drilling systems.

SUMMARY OF THE INVENTION

One aspect of the invention is a fluid transfer device for use in wellbore drilling that includes at least one pressure vessel having a fluid port at a bottom thereof for entry and discharge of a working fluid and a fluid port at a top thereof for entry and discharge of a power fluid. The pressure vessel has no physical barrier between the power fluid and the working fluid. Valves are coupled to the power fluid port for selective introduction of the power fluid into the at least one pressure vessel. Valves are coupled to the working fluid port such that the working fluid is constrained to flow in only one direction.

Other aspects and advantages of the invention will be apparent from the description and claims which follow.

DETAILED DESCRIPTION

Figure 1:
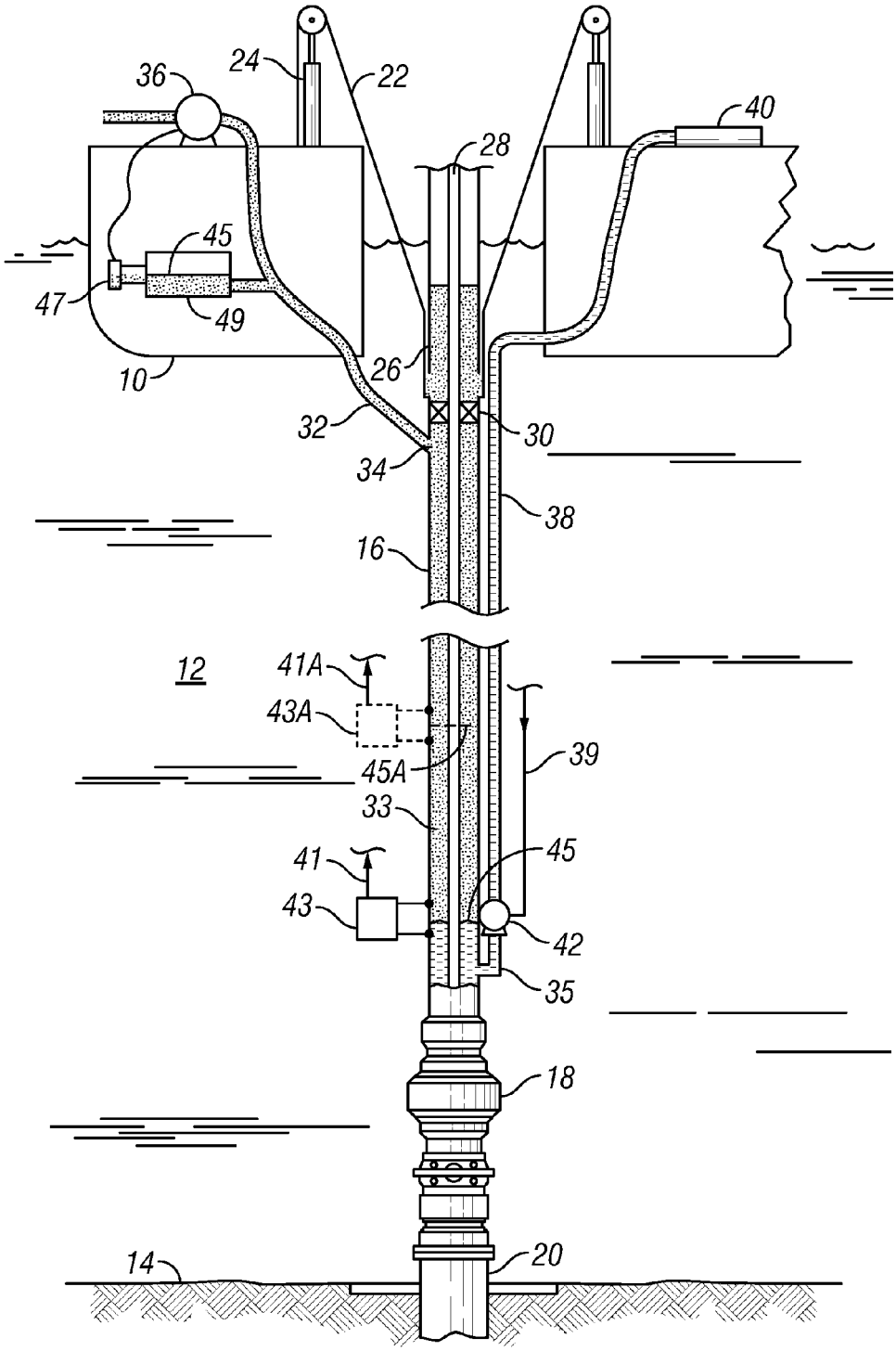
FIG. 1 shows an example drilling system using a separate drilling fluid return line having a pump therein to provide a selected fluid pressure in a wellbore annulus.

FIG. 1 shows a drilling vessel 10 floating on a body of water 12 with the bottom thereof shown at 14. A riser pipe 16 connects the drilling vessel 10 to a subsea wellhead 18 which is provided with blowout preventers 18 and other necessary valves and is mounted on a casing 20 which extends below the water bottom 14. The upper end of the riser pipe 16 is supported from the drilling vessel 10 by cables or lines 22 connected to constant tensioning devices 24 in a known manner. A slip joint 26 is provided in the riser pipe 16 in its upper end and a drill string 28 is supported within the riser pipe 16 from a derrick (not shown) on the drilling vessel 10.

A seal 30 is provided in the upper end of riser pipe 16. The seal 30 can be a Hydril brand Bag Type BOP such as Type GL or GK shown in the 1978-79 *Composite Catalog*, Pages 36-40. To decrease the wear on seal 30, an optimal section or joint of polished drill pipe can be threaded into the drill string just below the kelley and kept in that position during the drilling of the well. A light-weight fluid conduit 32 is connected at point 34 to the interior of the riser pipe 16 and extends to a pump 36 and a supply of lightweight fluid not shown. A return mud flow line 38 connects into the annulus of the riser pipe 16 just above wellhead 18 and extends to mud return tanks and facilities 40 which are carried by the drilling vessel 10. The return mud line 38 can be one of the "kill and choke" lines with appropriate bypass valving for the pump. A fluid transfer device system 42 according to the invention may be provided in the lower end of mud return conduit 38.

In FIG. 1, the fluid transfer device system 42 can be controlled by a level control means 43 to sense and control the interface 45 between the lightweight fluid 33 and the heavy drilling mud 35. This prevents a full head of heavy drilling fluid in conduit 38 from being applied to the drilling mud at depth. There can be a series of level control means 43, 43A along the riser pipe with output lines 41, 41A going to the surface where one can select which level 45, 45A, etc., is needed to obtain the desired pressure gradient. The output from the selected level control is used to send a control signal down line 39 to pump (fluid transfer device) 42. The lightweight fluid upper level 45 is controlled by a level sensor 47 with a suitable circuit to average the heave effect. Level 45 is detected in container 49 which is connected to line 32. In the case where the lightweight fluid is a gas, it is controlled by a pressure regulator instead of level sensor 47. The output of liquid level control sensor 47 or of the pressure regular controls pump 36 so as to maintain a constant level 45 or selected pressure.

The lightweight fluid may also be sea water, which weighs approximately 8.6 lbs/gal or it may be nitrogen gas. The heavy mud which it replaced may weigh as much as 18 lbs/gal or more. Without the system shown in FIG. 1, the tension needed to be applied to riser 16 from the vessel 10 would typically be 400,000 lbs. With the system, using a lightweight fluid such as sea water, the tension which needs to be applied is only 200,000 lbs. This example is for a 16" riser with flotation, in 1260' of water, an 18 lbs/gal drilling fluid, 50 foot of vessel offset, 1 ft/sec current, 25 ft, 11-second waves, and maximum lower ball angle of 4 degrees.

Regardless of what kind of riser fluid is used (liquid or gas), pressure sensors may be used to control the interface level by measuring the hydrostatic head of the fluid above the sensor. In such cases the seal 30 may be omitted. See U.S. Pat. No. 7,677,329 issued to Stave and incorporated herein by reference.

It is to be clearly understood that the example drilling system shown in FIG. 1 is only one possible drilling system that can use a fluid transfer device according to the invention. Any other known configuration of drilling system using a fluid transfer device in the mud return line may be used with the present fluid transfer device. Examples of such systems include, without limitation, systems shown in U.S. Pat. No. 7,264,058 issued to Fossli; U.S. Pat. No. 6,454,022 issued to Sangesland and U.S. Pat. No. 6,415,877 issued to Fincher et al., U.S. Pat. No. 7,677,329 issued to Stave, U.S. Pat. No. 6,505,691 issued to Judge et al., each of which is incorporated fully herein by reference.

Figure 1A:
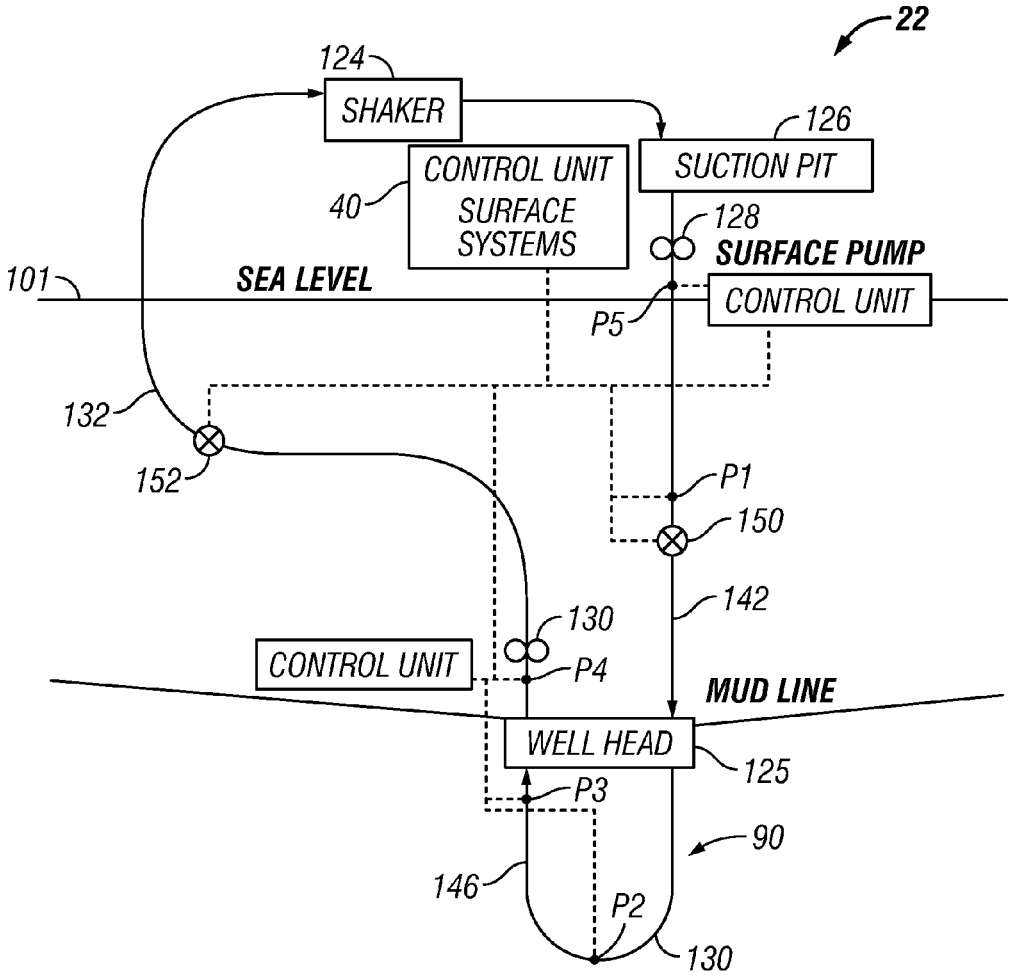
FIG. 1A shows an alternative drilling system.

For example, another drilling system is shown in FIG. 1A, a mud pit 126 at the surface is a source of drilling fluid that is pumped into a drill pipe 142 by surface pump 128. After passing through tubing 142, the mud is used to operate the BHA 130 and returns via the annulus 146 to the wellhead 125. Together the tubing 142, annulus 146 and the return line 132 constitutes a subsea fluid circulation system.

The adjustable fluid transfer device 130 in the return line provides the ability to control the bottom hole pressure during drilling of the wellbore, which is discussed below in reference to FIGS. 2 and 3. A sensor P1 measures the pressure in the drill line above an adjustable choke 150 in the tubing 142.

A sensor P2 may be provided to measure the bottom hole fluid pressure and a sensor P3 may be provided to measure parameters indicative of the pressure or flow rate of the fluid in the annulus 146. Above the wellhead, a sensor P4 may be provided to measure parameters similar to those of P3 for the fluid in the return line and a controlled valve 152 may be provided to hold fluid in the return line 132. In operation, a control unit 140 and the sensor P1 operate to gather data relating to the tubing pressure to ensure that the surface pump 128 is operating against a positive pressure, such as at sensor P5, to prevent cavitation, with the control unit 140 adjusting the choke 150 to increase the flow resistance it offers and/or to stop operation of the surface pump 128 as may be required. Similarly, the control system 140 together with sensors P2, P3 and/or P4 gather data, relative to the desired bottom hole pressure and the pressure and/or flow rate of the fluid in the return line 132 and the annulus 146, necessary to achieve a predetermined downhole pressure. More particularly, the control system acting at least in part in response to the data from sensors P2, P3 and/or P4 controls the operation of the adjustable fluid transfer device 130 to provide the predetermined downhole pressure operations, such as drilling, tripping, reentry, intervention and recompletion. In addition, the control system 140 controls the operation of the fluid circulation system to prevent undesired flow of fluid within the system when the fluid transfer device is not in operation. More particularly, when operation of the pumps 128, 130 is stopped a pressure differential may be resident in the fluid circulation system tending to cause fluid to flow from one part of the system to another. To prevent this undesired situation, the control system operates to close choke 150 in the tubing, valve 152 in the return line or both devices. The adjustable fluid transfer device 130 will be explained below in more detail with reference to FIGS. 2 and 3. In the FIG. 2 embodiment of the invention, the fluid transfer device 130 may be used with the separate return line 132, as shown, or may be used in conjunction with the conventional mud-filled riser (not shown).

The fluid transfer device may be used in conjunction with any kind of subsea drilling system; riserless tophole drilling (pre BOP), riserless post BOP drilling (as shown in FIG. 1A) as well as drilling with a Marine Drilling Riser as shown in FIG. 1.

Figure 2:
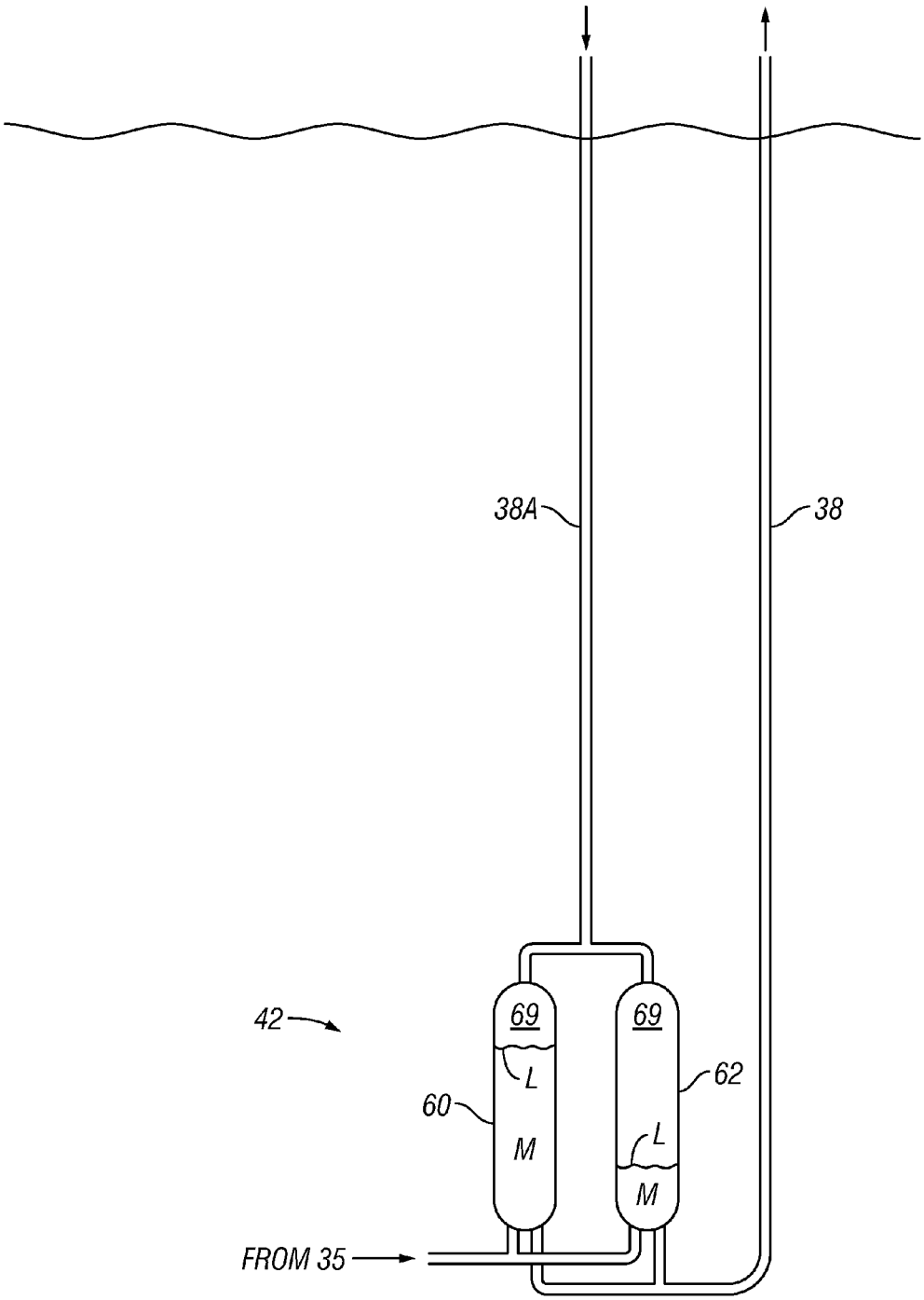
FIG. 2 shows one an example of an energy transfer device according to the invention.

FIG. 2 shows an example fluid transfer device system according to the invention. The system 42 may include at least one, shown at 60, or more, a second being shown at 62, pressure containment vessels. The pressure containment vessel(s) 60, 62 are preferably relatively large as compared with similar pressure vessels used with pumps known in the art. See, e.g., U.S. Pat. No. 6,505,691 issued to Judge et al.; in the present example the pressure vessels 60, 62 may be 40 inches in diameter and about 20 feet in height. These example dimensions are not a limitation on the scope of the invention. In the example shown in FIG. 2, a level L of working fluid is shown, which in the present case is the drilling mud M (shown entering the riser 16 in FIG. 1 at 35). An energizing or power fluid 69 is introduced into the each pressure vessel 60, 62 from a line 38A extending to the vessel (10 in FIG. 1). In the present example of energy transfer device, there is no separator between the power fluid 69 and the working fluid M. The power fluid 69 may be any kind of light weight liquid (e.g., sea water) or it may be gas or combinations thereof. For purposes of the invention, the dimensions of the pressure vessel(s) and the rate at which the power fluid 69 is introduced into the pressure vessel(s) should be selected such that very little, if any, mixing of the power fluid 69 and the working fluid M takes place. Thus, the power fluid 69 should be less dense than the working fluid M and should in the short term be relatively immiscible in the working fluid M. As will be explained in more detail with reference to FIG. 3, as the power fluid 69 is introduced into the pressure vessel(s), the working fluid is discharged through the bottom of the pressure vessel and enters the mud return line 38. As the working fluid M is discharged into the mud return line 38, the level L of the interface between the power fluid 69 and the working fluid M is lowered. When the level L reaches a predetermined minimum height inside the pressure vessel(s), the power fluid 69 is released from the pressure vessel(s) so that working fluid M from the well (e.g., at 35 in FIG. 1) can enter the pressure vessel(s) and cause the level L to rise until a predetermined height is reached.

Figure 3:
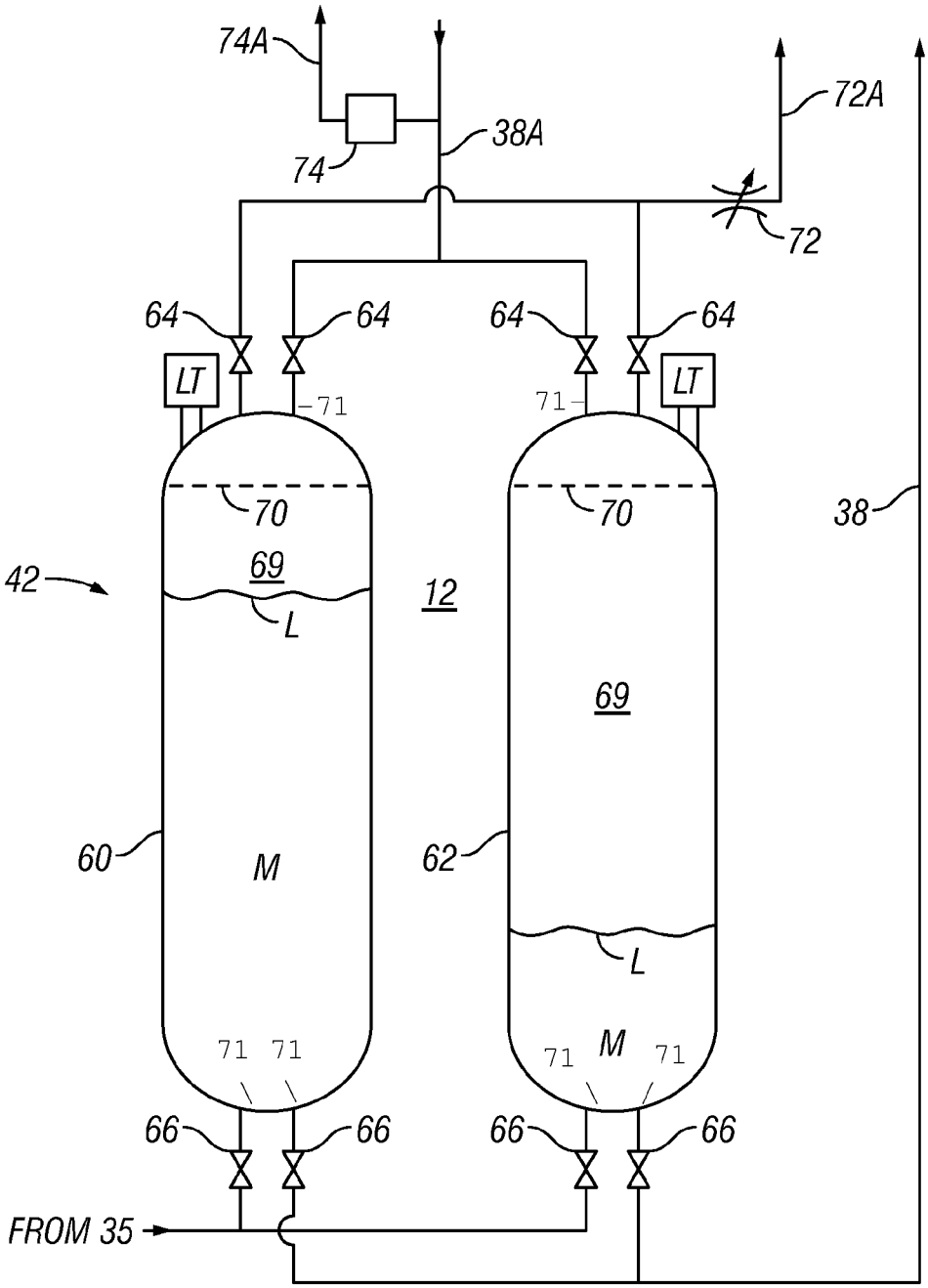
FIG. 3 shows a pumping system using an energy transfer device according to the invention.

FIG. 3 shows the system of FIG. 2 in more detail. Introduction of power fluid 69 into each of the pressure vessels 60, 62 may be controlled by power (e.g., electric or hydraulic) operated valves 64 each in hydraulic communication proximate the top of the respective pressure vessel 60, 62 through a respective port 71. Two ports are shown in each pressure vessel 60, 62, however one port may also be used. Pressure of the power fluid 69 may be limited by a safety and/or regulator valve 74, which may be fixed pressure or selectable pressure. For each pressure vessel 60, 62, the valve 64 is opened until the level L of the working fluid M drops to a selected height inside the pressure vessel 60, 62. The level L may be measured by a level transducer LT of types well known in the art. When the selected level is reached, the power operated valve 64 that enables the power fluid to enter the pressure chamber 60, 62 (inlet valve) is closed. An adjustable choke 72 may be used to control the rate of fluid transfer in the pressure chamber 60, 62. Each pressure vessel 60, 62 includes respective ports 71 proximate the bottom thereof. Two ports for each pressure vessel 60, 62 are shown, however only one port may be used in other implementations.

The system shown in FIG. 3 may in some embodiments include a pump (not shown) coupled at its intake to the power fluid discharge (e.g., after adjustable choke 72) to reduce the pressure at the power fluid discharge to below the hydrostatic pressure of the water 12 at the depth of the fluid transfer system.

In some examples, a device may be included between the wellbore discharge (35 in FIG. 1) and the working fluid intake to the fluid transfer system to break up formation cuttings and coagulated drilling fluid and cuttings ("gumbo") and to provide a nominal feed in pressure to the system. In some examples the device may be a slurry pump, which may, in addition to breaking up cuttings and coagulated fluid, provide a nominal pressure at the intake to the fluid transfer device.

When the selected level of working fluid is reached such that the inlet valve is closed another power operated valve 74 (outlet valve) may be opened to discharge the power fluid 69 into the water 12. When the power fluid 69 is so depressurized, working fluid M can then flow into the bottom of the pressure vessel 60, 62 until the level thereof L reaches a predetermined height inside the pressure vessel 60, 62. One way (check) valves 66 may be provided between the mud outlet on the wellbore (35 in FIG. 1) and inlet and outlet lines on the bottom of each pressure vessel 60, 62 so that the working fluid M flows only in the direction from the well connection (35 in FIG. 1) to the drilling vessel (10 in FIG. 1) up the mud return line 38. The check valves 66 may be passive or may be power actuated as are the inlet and outlet valves 64 for the power fluid 69. Alternatively, under certain circumstances to be explained below, the power fluid 69 is preferably not discharged into the water but maybe returned to the surface or to a portion of the riser above the drilling fluid interface level. Valves 72 and 74 in such implementations may each have a corresponding discharge line 72A, 74A to conduct the discharged power fluid 69 to the surface or to the upper portion of the riser.

In certain situations, particularly during a gas kick (uncontrolled entry of formation gas into the wellbore), there may be a risk of gas-hydrates forming. The extent of gas hydrate formation will be dependent on the amount of free gas present in the well bore, in combination with the existing specific pressure and temperature near the bottom of the riser.

To prevent hydrate formation, it can be desirable to use a driving fluid 69 that has chemical properties making it such that is cannot be discharged to the water. Non-limiting examples of such driving fluids are glycol or base oil.

In these cases it may be necessary to have a separate path (as explained above with reference to 74A and 72A in FIG. 3) to return the drive fluid 69 back to the rig (or to the riser above the mud interface) such that discharge to sea is avoided, and that the driving fluid can be reused. The return path can be either at separate return conduit (hard pipe or flexible) as shown in FIG. 3, or the drive fluid 69 can be retuned back into the drilling riser (16 in FIG. 1). In the case of returning the fluid back into the drilling riser, the riser must be liquid filled with a "blanket fluid" that preferably is the same as the drive fluid. The drive fluid return path may preferably be at an elevation above the mud/blanket fluid interface level. See, for example, 33 in FIG. 1.

Valves 64 and 66 may be one way vales or combined into two way valves as appropriate.

Near the top of the interior of each pressure vessel 60, 62, a permeable swash plate 70 or other type of flow diffuser may be included to reduce the possibility of the power fluid 69 "jetting" into the working fluid M, thus reducing the possibility of mixing the power fluid 69 and the working fluid M.

A fluid transfer device according to the various aspects of the present invention may provide lower maintenance costs, more efficient operation and lower cost to make than similar devices known in the art which rely on barriers to separate the working fluid from the power fluid.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A fluid transfer device for use in wellbore drilling, comprising:

at least one pressure vessel having a fluid port proximate a bottom thereof for entry and discharge of a working fluid into and out of the at least one pressure vessel and a fluid port proximate a top thereof for entry and discharge of a power fluid into and out of the at least one pressure vessel;

wherein the at least one pressure vessel has no physical barrier between the power fluid and the working fluid, wherein dimensions of the at least one pressure vessel are selected with respect to a rate of movement of the power fluid into and out of the at least one pressure vessel to substantially prevent mixing of the power fluid and the working fluid;

valves coupled to the fluid port proximate the top of the at least one pressure vessel for selective introduction and removal of the power fluid into and out of the at least one pressure vessel; and valves coupled to the fluid port proximate the bottom of the at least one pressure vessel and arranged such that the working fluid is constrained to flow in only one direction through an inlet line and an outlet line in hydraulic communication with a respective one of the valves coupled to the fluid port proximate the bottom of the at least one pressure vessel.

2. The fluid transfer device of claim 1 further comprising a flow diffuser proximate a top of the interior of the at least one pressure vessel to reduce jetting of the power fluid and consequent mixing of the power fluid and the working fluid.

3. The fluid transfer device of claim 1 further comprising a level sensor associated with the at least one pressure vessel.

4. The fluid transfer device of claim 1 wherein one of the valves coupled to the working fluid inlet is coupled to a drilling mud outlet of a subsea wellbore.

5. The fluid transfer device of claim 1 wherein one of the valves coupled to the working fluid inlet is coupled to a mud return line extending to a drilling vessel on the surface of a body of water.

6. The fluid transfer device of claim 1 wherein the power fluid comprises water.

7. The fluid transfer device of claim 1 further comprising an adjustable choke disposed in a power fluid discharge line to control a rate of fluid transfer.

8. The fluid transfer device of claim 1 further comprising a pump coupled at its intake to a power fluid discharge such that a pressure of the power fluid discharge is maintainable below a hydrostatic pressure of a body of water at a depth at which the fluid transfer device is disposed.

9. The fluid transfer device of claim 1 further comprising a cuttings break up device disposed between a working fluid inlet to the device and a wellbore fluid outlet, the cuttings break up device usable to break up formation cuttings and coagulated formation and drilling fluid.

10. The fluid transfer device of claim 9 wherein the device comprises a slurry pump, the slurry pump also providing a nominal pressure at the intake to the fluid transfer device.

11. The fluid transfer device of claim 1 wherein a power fluid discharge is coupled to at least one of a position on a drilling unit above the water surface or to a position in a drilling riser above an interface level of drilling fluid maintained in the riser by the fluid transfer device.

12. The fluid transfer device of claim 11 wherein the power fluid comprises a fluid that reduces formation of hydrates in the presence of free gas in the fluid transfer device and/or in the wellbore.

* * * * *